United States Patent [19]

Frei

[11] 4,160,515

[45] Jul. 10, 1979

[54] CLOTHES HANGER

[76] Inventor: Ernst Frei, Markstrasse 40, A-6971 Hard, Vorarlberg, Austria

[21] Appl. No.: 862,012

[22] Filed: Dec. 19, 1977

[51] Int. Cl.[2] ..... A47J 51/14

[52] U.S. Cl. ..... 223/96

[58] Field of Search ..... 223/91, 93, 96; 211/119, 113; 24/261 R, 139, DIG. 10

[56] References Cited

U.S. PATENT DOCUMENTS

| | | | |
|---|---|---|---|
| 491,062 | 1/1893 | Granger | 223/96 |
| 835,757 | 11/1906 | Ingersoll | 24/139 |
| 2,004,284 | 6/1935 | Kellerth | 223/96 |
| 2,129,455 | 9/1938 | Wisehart et al. | 223/91 |
| 2,238,519 | 4/1941 | Drake | 223/96 |
| 2,529,742 | 11/1950 | Robertson | 223/91 |
| 2,536,719 | 1/1951 | Brandstetter | 24/139 |
| 2,545,156 | 3/1951 | Martin | 223/91 |
| 2,633,277 | 3/1953 | Fortner et al. | 223/96 |

FOREIGN PATENT DOCUMENTS

| | | | |
|---|---|---|---|
| 212809 | 3/1924 | United Kingdom | 223/96 |
| 260377 | 11/1926 | United Kingdom | 223/96 |

*Primary Examiner*—George H. Krizmanich
*Attorney, Agent, or Firm*—Lowe, Kokjer, Kircher, Wharton & Bowman

[57] ABSTRACT

The invention relates to a wire clothes hanger having an upwardly projecting hook, and two cantilever arms extending from the hook in opposite directions. The free end of each of the arms is bent to form a downwardly projecting pair of spring jaws which are capable of gripping an article of clothing.

2 Claims, 5 Drawing Figures

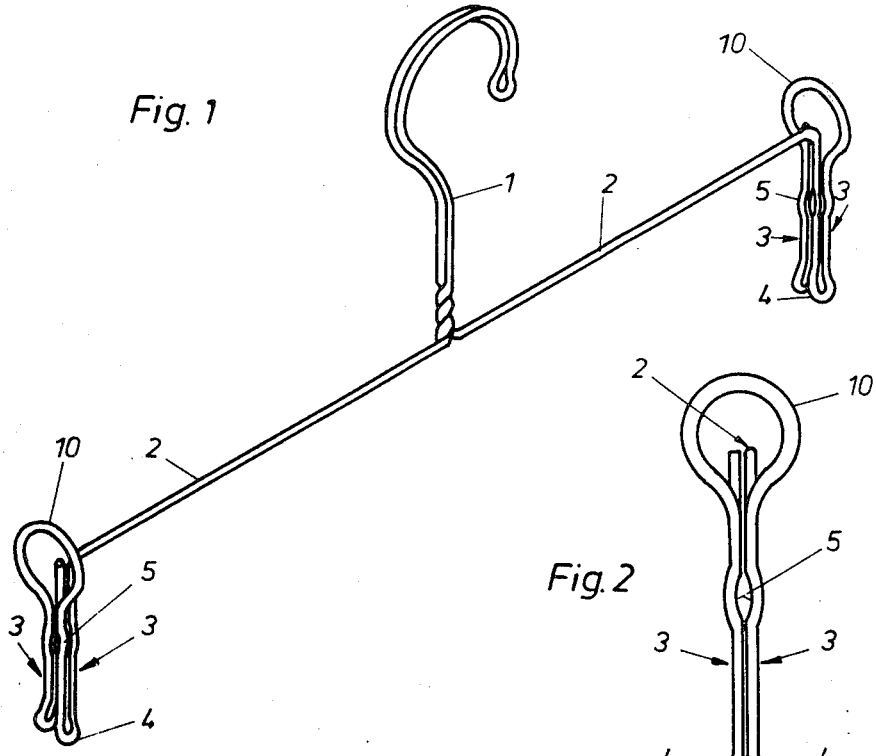
Fig. 1
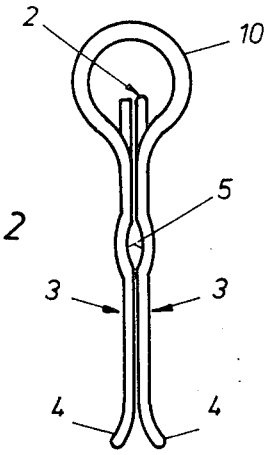
Fig. 2
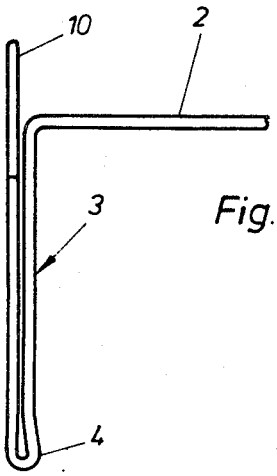
Fig. 3
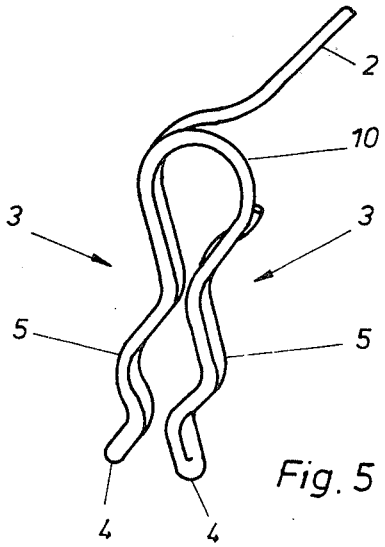
Fig. 5
Fig. 4
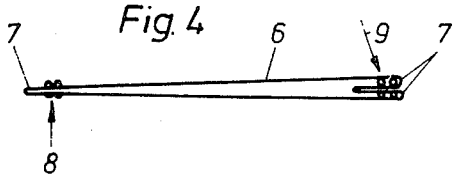

CLOTHES HANGER

The invention relates to a clothes hanger having an upwardly projecting hook, two arms extending from the hook in opposite directions, and at the free end of each of the arms, means for attaching an article of clothing.

Clothes-hangers of this kind are used essentially for hanging up trousers, in which case the known constructions provide for one or a pair of cheeks at both ends of the hanger, the distance apart of these cheeks being adjustable as a result of the arms carrying the cheeks being slidably mounted relatively to the hook. Furthermore coil springs are used which cause the cheeks to be extended to their outermost position or bear with the spring loading against a suitable object, for example inside the leg of a pair of trousers. Through the constant change of fashion it is necessary to produce many different sizes of such clothes-hangers, since normally the springs only have a limited range of extension.

Again, a trouser-stretcher is known which consists of a hook, two arms extending from the hook in opposite directions and carrying upwardly directed cheeks. Here too there is the disadvantage once again that the clothes-hanger is only usable with trousers having a particular width of leg. Therefore, when used where many pairs of trousers have to be hung up, for example, in factories for ready made clothing, in textile houses, and in drycleaning plants, a large stock of clothes-hangers is necessary.

The invention is concerned with the problem of creating a clothes-hanger which can be applied universally to all kinds of trousers and also to other articles of clothing, and which besides these possibilities also involves a simple structural design.

Clothes-hangers involving the use of spring jaws have been proposed for example in British Pat. No. 576,423, and in U.S. Pat. Nos. 1,893,508 and 2,812,888, but these have been complex and not entirely satisfactory.

In accordance with the invention, a clothes-hanger has an upwardly projecting hook, two arms extending from the hook in opposite directions, and, at the free end of each of the arms, a downwardly projecting pair of spring jaws which are capable of gripping an article of clothing and which are formed of a bent wire.

With this simple construction, only one size of clothes-hanger is necessary, since the pairs of jaws do not have to be separated by the distance between the creases of a pair of trousers.

The trousers can be clamped between the two pairs of jaws provided on the arms of the clothes-hanger so that these get a very good hold. Furthermore it is also possible for a pair of trousers to be hung up by the waist since there need be no parts which are made springy in the direction along the arms.

The new clothes-hanger is obviously suitable for hanging, besides trousers, other articles of clothing, e.g. ladies' skirts.

Two examples of clothes-hanger constructed in accordance with the invention are illustrated in the accompanying drawings in which:

FIG. 1 is a perspective of one clothes-hanger;

FIG. 2 is an end elevation of one pair of jaws of the FIG. 1 hanger;

FIG. 3 is a front elevation of one end of the FIG. 1 hanger;

FIG. 4 is a diagrammatic plan showing a pair of trousers in the folded state gripped by the hanger jaws; and FIG. 5 is a perspective view of one end of another example of clothes-hanger.

The illustrated clothes-hanger consists of a hook 1 and two cantilever arms 2 extending from the hook in opposite directions, which at their free ends carry pairs of jaws 3. Each pair of jaws, which are urged resiliently together and, when unstressed, lie close together at intervals along their lengths, are swingable apart. The planes of swing of the jaws run approximately perpendicular to the extension of the arms 2. The article of clothing which is to be held by this clothes-hanger can thereby be introduced from below up between the jaws 3 and is then held frictionally between these jaws 3.

In order to guarantee easier introduction of the article of clothing the jaws of each pair are, at their free ends, bent away from one another at an acute angle, possibly in a curve.

Part way along their length, the jaws 3 have bulges 5 pointing in opposite directions in order thereby to increase the hold upon the article of clothing inserted, in particular when the waist of a pair of trousers or a lady's skirt is inserted.

From FIG. 4 it may be clearly seen how the attachment of, for example, a pair of trousers 6 onto the clothes-hanger may be effected. The pair of trousers 6 is folded in the usual way along the creases 7, so that one pair of jaws 8 seizes the rear part of the trousers from the outside, and the second pair of jaws 9 seizes the front region of the trousers turned back inwards, so that this pair of jaws 9 thus comes to lie inside the outer boundary of the trousers. It can be inferred from this sketch in FIG. 4 that a different size of clothes-hanger is not necessary for every size of a pair of trousers or a skirt, but that a clothes-hanger of that kind can be used universally for different sizes.

The illustrated hangers are bent from one piece of a steel wire. Obviously the possibility also exists of manufacturing merely the jaws 3 out of one piece of steel wire, in which case these parts are connected to the arms 2 in any way, for example, by welding. Thus the two jaws are connected together at their top ends, the region of the jaws 3 remote from the free end being designed as a springy hinge part 10. This springy part is in the example illustrated designed in the shape of a circular arc.

Obviously this springy part may be shaped as the arc of an ellipse, or as a polygon or other shape. The possibility also exists of forming the springy part 10 out of a section of the jaws 3 which is coiled two or more times. The springy part would then, so to speak, be made after the style of a coiled torsion spring.

The jaws 3 are each formed of two wire portions which run in parallel with one another, the portions being continuations of one another and interconnected by a bend at the free end of the jaw. By that it is also guaranteed that the trousers or skirt to be slid in cannot be damaged in any way, since the jaws are rounded off at their slide-in ends.

The free ends of the steel wire forming the jaws point towards the springy part 10, so that they do not come into contact at all with the skirt or trousers to be slid in. In the example shown the double sections of wire of both jaws 3 lie in planes which lie in parallel with one another. It would also be conceivable that these double sections of wire of both jaws 3 are so arranged that they lie in a common plane. The spring tension would thereby be considerably increased again.

For reduction of the structural height of the clothes-hanger it is proposed that the springy part 10 project above the top of the respective arm 2. The clamping length of the jaws is then sufficient, so that thus the actual part which holds the jaws 3 together may readily be arranged above them.

As already stated the jaws, the arms and the hook are bent up in one piece from steel wire. It is also conceivable that the steel wire 3 forming the jaws is connected rigidly, for example, welded to the arms 2 of the clothes-hanger, which are formed of steel wire.

The production costs in the case of such a clothes-hanger are obviously very low, since it is merely necessary for a steel wire to be bent up into the appropriate shape. Especially in the case of much use, such as there is in drycleaning plants or readymade clothing factories, this clothes-hanger guarantees wide possibilities of use without special expenditure. The shape of the hook and the arms as well as the jaws too, may obviously be chosen in various ways. What is essential is merely that there are two jaws or respectively one pair of jaws in each case, the jaws of which are swingable and lie springily against one another.

FIG. 5 shows another example of the novel clothes-hanger. There the steel wire which forms at least the arms 2 and the jaws 3, but preferably also the hook 1, is bent down where it comes from the arms into corrugations as far as the point of bend 4, thence in corrugations parallel to the first corrugations up to the arched springy part 10, thence again downwards in corrugations to the other point of bend 4 and thence again in parallel corrugations back into the region of the arched springy part 10. The embodiment as FIG. 5 differs from the embodiment as FIGS. 1 and 2 essentially in that the curved corrugations 5 are more pronounced, which produces a particularly good clamping force, even with a number of layers of material of the article of clothing in question. The space formed between the corrugations 5 is preferably rather longish in order to allow of easy introduction of the article of clothing involved.

For the same reason the steel wire in the region of the point of bend 4 is bent outwards. The springy part 10 is preferably bent in the shape of a circular arc. Also in the case of the embodiment as FIG. 5 a number of layers of steel wire are lying closely one behind the other, that is, altogether two layers at each side of each jaw 3, as in the case of the embodiment as FIGS. 1 and 2.

If the whole clothes-hanger is produced from steel wire it may be provided with a suitably protective coating of varnish. This is, for example, an electrolytic coating of varnish. The varnish may also be applied electrostatically. In order to avoid bridges of varnish between the jaws 3 these jaws have a slight clearance from one another.

With this embodiment one is in the position to produce any degree of prestress between the jaws 3. Production of the clothes-hanger is also particularly favourable in cost.

The bow of the springy part 10 lies at the level of the arms 2. Upon introducing articles of clothing, therefore, it is unlikely that they will touch the arms 2.

I claim:

1. A clothes hanger which is integrally formed from a single piece of wire and comprises an upwardly projecting hook, two arms extending from the hook in opposite directions, and, at the free end of each of the arms, a downwardly projecting pair of spring jaws adapted to grip an article of clothing and opening and closing by a relative swinging movement in planes laying substantially perpendicular to the extension of the arms, wherein each of the pair of jaws is formed by the wire leading from the end of a respective one of the arms bent substantially 90° downwardly and extending downward to a 180° bend to form a free end and upwardly to form one of the jaws, over an open, bulbous bend to form a springy hinge part lying in a plane substantially perpendicular to said arm, and downwardly to a 180° bend to form a free end and upwardly to form the other of the jaws and terminating adjacent the end of the arm, whereby each jaw is formed by two wire portions which run substantially parallel to one another and are corrugated in a direction towards and away from the other jaw of that pair so that the two jaws of the pair lie closely adjacent to one another at two positions between the springy hinge part and the free ends of the jaws and bulge apart between these two positions, and the free ends of the two jaws diverging away from one another to admit clothing to said jaws.

2. A clothes hanger according to claim 1, wherein the springy hinge part projects above the end of the respective one of the arms.

* * * * *